United States Patent [19]

Bigotti

[11] 4,160,571

[45] Jul. 10, 1979

[54] SHOE CABINET

[76] Inventor: Alberto Bigotti, 1446 Pine St., San Francisco, Calif. 94109

[21] Appl. No.: 931,860

[22] Filed: Aug. 7, 1978

[51] Int. Cl.[2] ..... A47F 7/08

[52] U.S. Cl. ..... 312/327; 312/322; 312/324; 312/DIG. 33; 211/37

[58] Field of Search ..... 312/327, 328, 313, 322, 312/DIG. 33, 324; 211/37

[56] References Cited

U.S. PATENT DOCUMENTS

| | | | |
|---|---|---|---|
| 574,057 | 12/1896 | Barrows | 312/328 |
| 762,888 | 6/1904 | Decker | 312/327 |
| 789,782 | 5/1905 | Yates | 211/37 |
| 790,669 | 5/1905 | Winship | 211/37 |
| 1,488,456 | 3/1924 | Harper | 312/DIG. 33 |
| 2,785,036 | 3/1957 | Elsden-King et al. | 312/327 |
| 2,995,409 | 8/1961 | Simonsen | 312/DIG. 33 |

FOREIGN PATENT DOCUMENTS

| | | | |
|---|---|---|---|
| 1172017 | 6/1964 | Fed. Rep. of Germany | 211/37 |
| 367602 | 4/1963 | Switzerland | 211/37 |
| 421425 | 9/1966 | Switzerland | 211/37 |

*Primary Examiner*—Victor N. Sakran
*Attorney, Agent, or Firm*—J. M. Rosso

[57] ABSTRACT

Inner and outer shelves, having wooden dowels for holding shoes thereon, are vertically disposed within a cabinet frame with the upper end of the inner shelf being hingedly connected to the rear of the frame and with the lower end thereof being hingedly connected to the lower end of the outer shelf. The lower end of the outer shelf is also hingedly connected to the front of the frame such that the outer shelf can be pivoted to a substantially horizontal position, thereby causing pivoting of the inner shelf to a diagonal position, with ready access to the shoes on either shelf. Preferably, two pairs of inner and outer shelves are employed, in separate compartments one above the other, with a storage compartment disposed above the shelf compartments.

1 Claim, 4 Drawing Figures

SHOE CABINET

BACKGROUND OF THE INVENTION

This invention relates to shoe cabinets, and more particularly to a cabinet having shoe-holding shelves which can be folded into a closed position within the cabinet.

This application is a substitute of the application filed Apr. 27, 1977 as Ser. No. 791,502.

A wide variety of racks for supporting shoes and similar articles are presently available, such as those disclosed in U.S. Pat. Nos. 2,294,504; 1,198,431; and 1,874,056. Display racks for shoes or packaged goods such as canned foods and the like, are also available, as the rack of U.S. Pat. No. 1,423,417. Such racks, whether designed for storage or display or both, are almost exclusively constructed in the form of hingedly connected bars which can be readily and easily folded into small and compact articles so that they may be readily transported or stored.

A number of such racks, such as that of U.S. Pat. No. 1,198,431, are designed for the transport of shoes from one part of a shoe factory to another. Some are designed with shipping purposes in mind, with retractable portions such that a plurality of racks can be more easily nested together when they are being packed for shipment. Other racks, usable by individuals for holding shoes, flower pots and other articles, can be extended and locked in position when in use to receive the objects and when not in use can be folded up and locked, so as to occupy as small a space as possible.

Cabinets for use in households for the storage of shoes and other compact articles of clothing are also available. Although such cabinets are more practical than the shoe racks for storage purposes, they are at the same time disadvantageous in that shoes stored are not readily accessible. Moreover, shoes stored in such cabinets cannot be efficiently presented for display purposes or for inspection or selection by the individual. Also, shoes stored in conventional cabinets can not be firmly held in paired, side-by-side position, as is desirable.

In sum, none of the above cabinets provides for adequate storage of shoes and at the same time allows for ready access or inspection of the shoes in a desired side-by-side position.

SUMMARY OF THE INVENTION

In accordance with this invention, a shoe cabinet is provided comprising a frame having front and rear portions and inner and outer shoe-holding shelves vertically disposed within the frame. The inner shelf is hingedly connected at its upper end to the rear of the frame and at its lower end to the lower end of the outer shelf, the latter also being hingedly connected to the frame at the front portion thereof. The outer shelf can be pivoted away from the frame to a substantially horizontal position, thereby causing pivoting of the inner shelf to a diagonal position within the frame. Wooden dowels or similar shoe-holding means are provided across both inner and outer shelves such that shoes in pairs can be spaced along both shelves. The outer shelf can then be pivoted to its closed, vertical position, causing the inner shelf to similarly pivot to its closed, vertical position, with the shoes on both shelves being held in place within the cabinet frame. When display or selection of a pair of shoes is required, the outer shelf need only be pivoted outwardly as noted to provide for ready access to shoes on either of the two shelves.

It is therefore a primary object of this invention to provide a cabinet for the storage of shoes within the smallest possible space.

It is another object of this invention to provide a shoe cabinet having shoe-holding shelves which can be folded into the frame of the cabinet with the shoes in place in a paired, side-by-side position on the shelves.

It is yet another object of this invention to provide a shoe cabinet having compartments with inner and outer shoe-holding shelves which can be pivoted outwardly from the frame to an open position where the shoes are readily accessible for selection or display.

It is a still further object of this invention to provide a shoe cabinet having shoe-holding shelves foldable into the frame of the cabinet wherein one of the shelves serves as part of the outer surface of the front of the cabinet.

These and other objects of the invention will become apparent to those skilled in the art from a reading of the description of the preferred embodiment, as well as from examining the following described drawings.

DESCRIPTION OF THE PREFERRED EMBODIMENT

Figure 1:
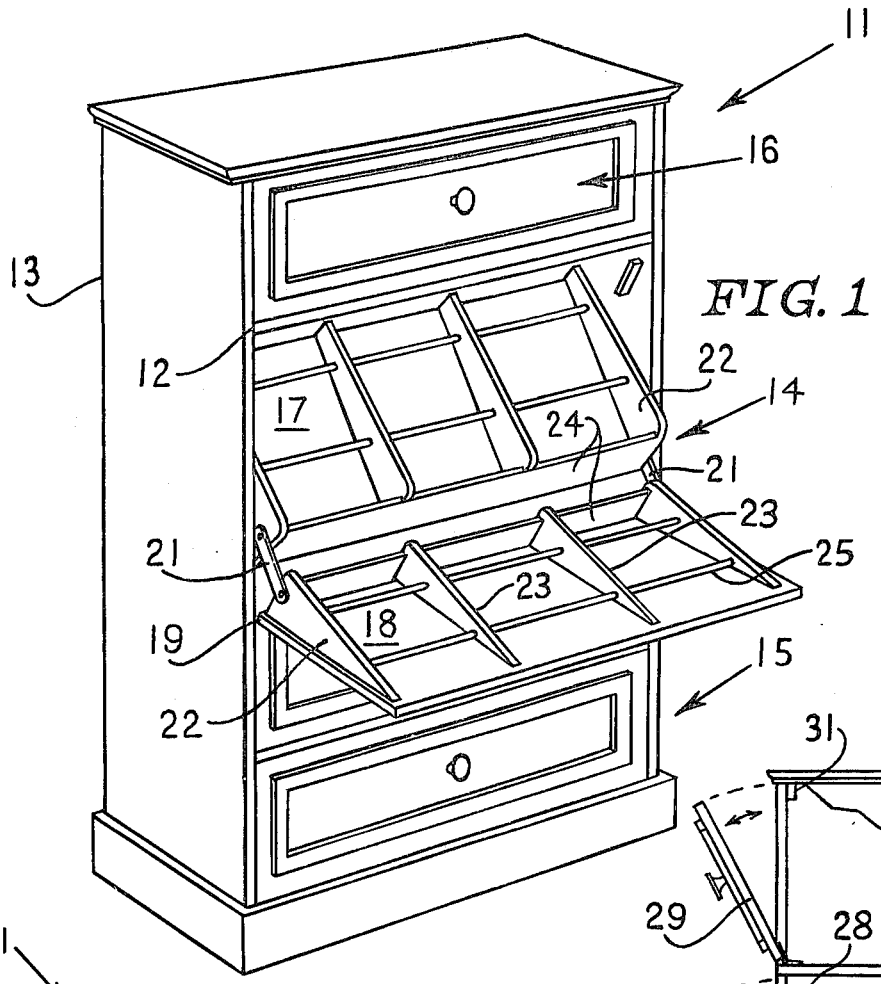
FIG. 1 is a perspective view of the shoe cabinet of this invention with the shoe-holding inner and outer shelves of one compartment pivoted into open position.
Figure 3:
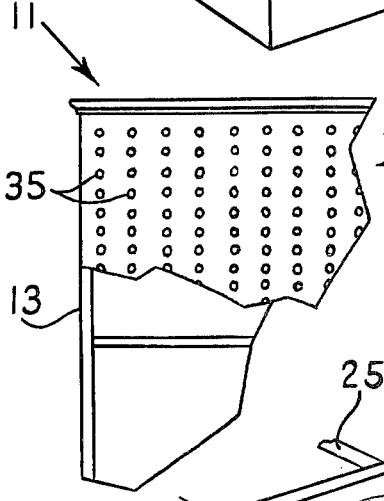
FIG. 3 is a fragmentary view of the rear portion of the cabinet.

Referring to FIG. 1, shoe cabinet 11 comprises a rectangular frame having a front portion 12 and a rear portion 13, with a pair of shoe compartments 14, 15, the upper compartment 14 being shown in open position. A storage compartment 16 can be disposed above the upper shoe compartment.

Figure 4:
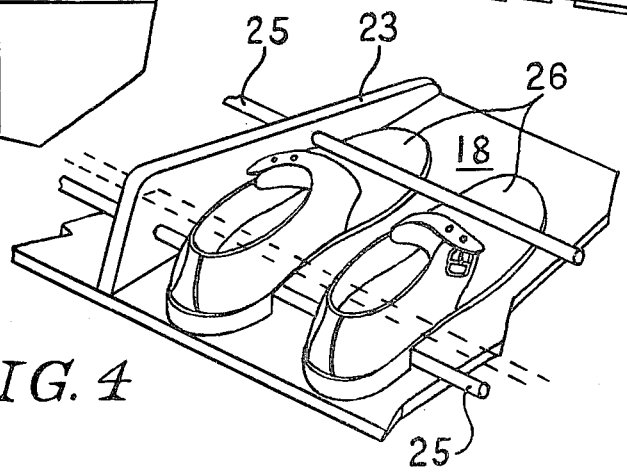
FIG. 4 is a fragmentary view of a shelf, showing a pair of shoes in place.

Each of the shoe compartments has an inner shoe-holding shelf 17 and an outer shoe-holding shelf 18, the shelves being hingedly connected, as will be described, such that they can be pivoted into a vertical position within the shoe cabinet with pairs of shoes held in side-by-side position thereon. Outer shelf 18 is hingedly connected at its lower end 19 to the front of the cabinet and is further hingedly connected to inner shelf 17 by means of metal bars 21, such that outer shelf 18 can pivot outwardly from the frame to a substantially horizontal position. Outward pivoting of outer shelf 18 causes inner shelf 17 to be pivoted by metal bars 21 to a diagonal position, as shown. Both inner and outer shelves have triangular side members 22, triangular brace members 23 and backing members 24 at the bases. A pair of dowels 25 run across each shelf from one triangular side member to the other, the dowels being so positioned that shoes 26 will be firmly held by them in position during pivoting of the shelves for both opening and closing of the shoe compartments, the shoes 26 being held as shown in FIG. 4.

Figure 2:
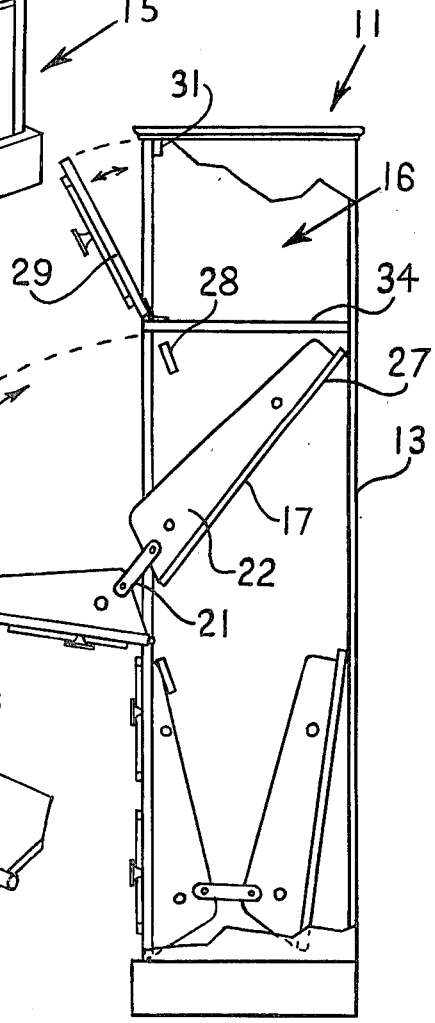
FIG. 2 is a side elevational view in section of the shoe cabinet shown in FIG. 1.

As shown in FIG. 2, inner shelf 17 is hingedly connected at its upper end 27 to the rear portion 13 of the shoe cabinet 11. Metal bar 21 runs from the mid-point of triangular side 22 of inner shelf 17 to the corresponding mid-point of the outer shelf 18, both mid-points being raised from the bottom thereof, and metal bar 21 being of such a length that outer shelf 18 is allowed to pivot to a substantially horizontal position or a slightly diagonal position as shown. Stops 28 are disposed along the sides of the shoe cabinet at the upper front portion of each shoe compartment to limit inward pivoting of the outer shelf. The outer surface of each outer shelf will become part of the front surface of the shoe cabinet when the shelves are in their closed position, as shown by the lower shoe compartment.

Storage compartment 16 has a hinged member 29 for opening and closing the compartment, the hinged member being held in its closed position by magnetic catch 31. Partition member 34 serves as a floor for the storage compartment.

The shoe cabinet of this invention, including the inner and outer shelves, can be constructed of any suitable material, such as metal or wood. Preferably, the shoe cabinet is constructed of wood and has a width of about $2\frac{1}{2}$ feet, a depth of about one foot, and a height of about $3\frac{1}{2}$ feet. The shelves can be constructed of $\frac{1}{2}$ inch thick plywood, including the triangular sides, with $\frac{3}{8}$ inch diameter wooden dowels. The metal bar connecting the shelves is preferably a $\frac{1}{8}$ inch flat bar which is 5 inches by $\frac{3}{4}$ inches.

The rear surface of the shoe cabinet can preferably be provided with ventilation holes 35, to allow air to freely circulate within the cabinet while the shoes are being stored.

Although only a specific embodiment of the shoe cabinet of this invention has been described, it is clear that modifications of the invention can be made by those skilled in the art without departing from the spirit thereof, as set forth in the following claims.

I claim:

1. A shoe cabinet comprising:

a frame having front and rear portions, an inner shoe-holding shelf vertically disposed within the frame with its upper end hingedly connected to the rear portion of the frame, an outer shoe-holding shelf vertically disposed within the frame with its lower end hingedly connected to the lower end of the inner shelf, the lower end of the outer shelf also being hingedly connected to the frame along its front portion such that the outer shelf can be pivoted away from the frame to a substantially horizontal position, thereby causing the inner shelf to pivot to a diagonal position within the frame, the inner and outer shelves further having triangularly shaped sides with their bases disposed at the lower end of each shelf and backing members running from one triangular base of each side to the other side, the shelves being hingedly connected by a metal bar running from an approximate mid-point on each of the triangular sides, the mid-point being located substantially above the base of each triangular side, a pair of dowels spaced apart and running from one triangular side to the other for holding shoes on the shelves as the shelves are pivoted into open and closed positions, said shoe cabinet additionally comprising stops disposed on the frame toward the upper front portion thereof for limiting fold-up of the outer shelf, and two shoe compartments, each containing a pair of inner and outer shelves, with one shoe compartment being disposed above the other.

* * * * *